US005078920A

United States Patent [19]

Maza

[11] Patent Number: 5,078,920

[45] Date of Patent: Jan. 7, 1992

[54] PROCESS FOR SEPARATING MIXED FATTY ACIDS FROM DEODORIZER DISTILLATE USING UREA

[75] Inventor: Aurelia Maza, Livingston, N.J.

[73] Assignee: CPC International Inc., Englewood Cliffs, N.J.

[21] Appl. No.: 515,938

[22] Filed: Apr. 27, 1990

[51] Int. Cl.[5] ..... C11B 3/10

[52] U.S. Cl. ..... 260/428; 260/412.5

[58] Field of Search ..... 549/413; 260/428, 412.5

[56] References Cited

U.S. PATENT DOCUMENTS 4,594,437 6/1986 Kumar ..... 549/413

*Primary Examiner*—Jose G. Dees
*Assistant Examiner*—Deborah D. Carr

[57] ABSTRACT

A process is described for separating deodorizer distillates, which are byproducts from processing vegetable and animal fats and oils, into a light fraction enriched in fatty acids and a heavy fraction enriched in tocopherols and sterols. Melted deodorizer distillate is added to a heated solution of urea dissolved in alcohol. The solution is preferably non-aqueous but may contain small quantities of water as an impurity. A crystalline complex of urea and fatty acid is formed which is removed from the solution and dried. The remaining mother liquor is saved for subsequent processing. The dried crystals are dissolved in water to yield an organic layer of fatty acids and an aqueous layer of urea. An organic fraction rich in tocopherols and sterols is separated in the same manner from the mother liquor, which was saved previously, by evaporating the alcohol to form a residue, mixing the residue with water and separating the organic layer.

20 Claims, 1 Drawing Sheet

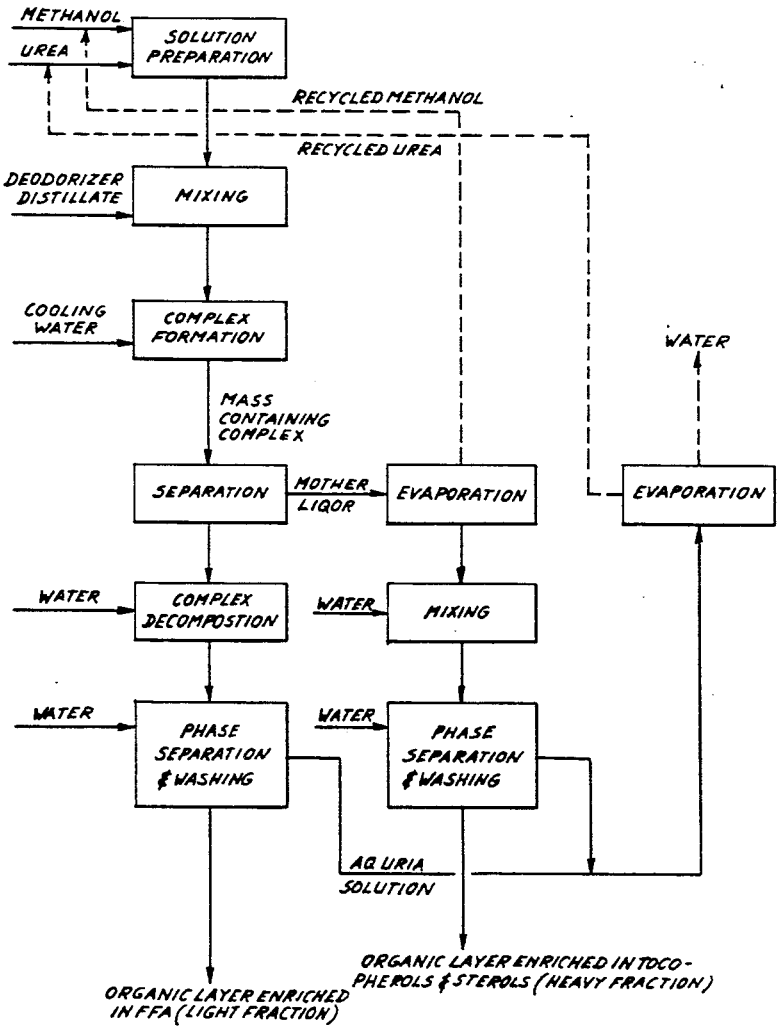

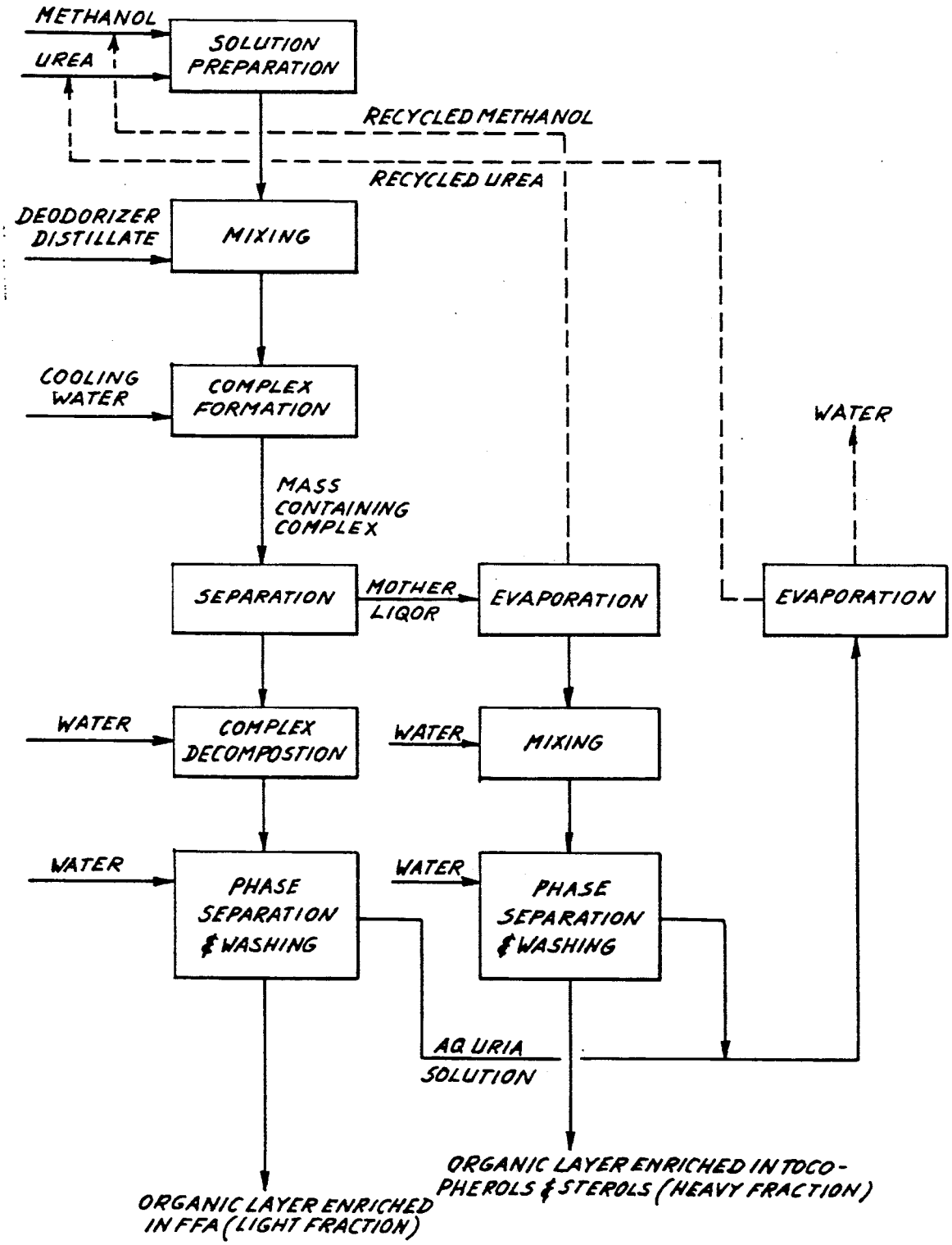
METHANOL
UREA
SOLUTION PREPARATION
RECYCLED METHANOL
RECYCLED UREA
DEODORIZER DISTILLATE
MIXING
COOLING WATER
COMPLEX FORMATION
WATER
MASS CONTAINING COMPLEX
SEPARATION
MOTHER LIQOR
EVAPORATION
EVAPORATION
WATER
COMPLEX DECOMPOSTION
WATER
MIXING
WATER
PHASE SEPARATION & WASHING
WATER
PHASE SEPARATION & WASHING
AQ URIA SOLUTION
ORGANIC LAYER ENRICHED IN TOCO-PHEROLS & STEROLS (HEAVY FRACTION)
ORGANIC LAYER ENRICHED IN FFA (LIGHT FRACTION)

PROCESS FOR SEPARATING MIXED FATTY ACIDS FROM DEODORIZER DISTILLATE USING UREA

BACKGROUND OF THE INVENTION

1. Field of the Invention

The present invention relates to methods for separating mixed fatty acids and mixed tocopherols and sterols from complex mixtures. More specifically, the invention relates to a process for improving the yield of mixed fatty acids, tocopherols, and sterols separated from deodorizer distillates which are a byproduct of the edible oils and fats industries.

2. Description of Related Art

Deodorizer distillates are produced as a byproduct of the steam treatment-deodorization step in processes for producing edible oils and fats from vegetable materials. They are also produced as a byproduct of the production of oils and fats from animals. The distillates are comprised of fatty acids, oils, tocopherols, sterols, oxidation products, and miscellaneous other impurities, and are generally used for the production of oleo chemicals and other value added products.

Various methods for separating organic compounds from complex mixtures using urea as a complexing agent have been described in the related art. The crystalline complexes formed by urea and the selected organic compounds are inclusion complexes rather than true chemical reaction products. These complexes are unstable and, consequently, their components are easily regenerated by various means, including melting or dissolving of the urea lattice. Upon regeneration, urea and the selected organic compounds are separated.

In U.S. Pat. No. 2,520,716, a method is described for the extractive fractionation of organic compounds from complex mixtures by the use of agents such as urea and thiourea. One aspect of the method is based on the knowledge that urea selectively forms crystalline complexes with hydrocarbons having substantially a normal chain structure. Conversely, urea appears to be inert in this respect toward branched compounds such as isoparafins and most cyclic compounds such as aromatics and naphthenes. According to the method described in the patent, organic compounds are used which have partial solubility for the complex-forming agent, relatively low solubility (substantial immiscibility) for the complex forming hydrocarbons, and low solubility for the urea/hydrocarbon complex. These compounds are admixed with the urea composition to improve selectivity of the process for separating particular types of compounds.

U.S. Pat. No. 2,596,344 discloses a process for fractionating mixtures of vegetable oil acids or their derivatives. The invention is based on the discovery that mixtures of straight chain polar organic compounds may be effectively separated into fractions respectively richer and poorer in the chemically less saturated components by clathrate compound formation with urea. The invention involves the fractionation of mixtures of acids derived from naturally occurring fats and oils. According to the process, mixtures of naturally occurring glycerides are intentionally hydrolyzed or alcoholyzed in order to destroy the typical triglyceride structure and to leave the free acids or the esters of monohydric straight chain alcohols. Fatty acid mixtures are diluted with methyl isobutyl ketone and then stirred with saturated aqueous urea solutions. This forms a crystalline precipitate which is subsequently separated and dissolved to recover high-purity individual fatty acids.

According to U.S. Pat. No. 2,717,890, unsaponifiable materials present in tall oil are separated from the fatty acid fraction therein by mixing the tall oil with a concentrated aqueous solution of urea until a fatty acid complex is formed. The crystalline complex is filtered off and urea is leached out with water. The fatty acid fraction recovered is substantially free of unsaponifiable material.

U.S. Pat. No. 3,720,696 relates to a process for specifically extracting 9-hexadecenoic acid from fatty acid mixtures. According to Example 1, the fatty acid mixture was added to a solution of urea in methanol. Prior to addition, the solution was maintained at a temperature of less than 100° C. Following addition, the solution was stirred and cooled to room temperature. The 9-hexadecanoic acid was ultimately recovered from the filtrate as a non-urea-addition product.

Urea is used in similar applications as a complexing agent in a process for isolating insect sex pheromones under U.S. Pat. No. 4,170,601; to purify eicosapentaenoic acid and its esters under U.S. Pat. No. 4,377,526 and to purify oleic acid under U.S. Pat. No. 4,601,856.

An improved process using urea for separating mixed fatty acids, tocopherols and sterols from deodorizer distillates has now been discovered. The process provides increased yields and reduced use of organic solvents.

SUMMARY OF THE INVENTION

According to the process of the present invention the yield of mixed fatty acids, tocopherols and sterols separated from deodorizer distillates is improved by following a specific process sequence. Principles of reaction equilibrium are used to enhance the reaction of urea with fatty acids to form a crystalline complex.

The deodorizer distillate is first melted and then is added to a refluxing solution of urea dissolved in alcohol to form a reaction mixture. A relatively small amount of alcohol is used compared to prior art processes which require dissolution of the deodorizer distillate in alcohol before it is added to the urea solution. Environmental concerns relative to the handling and disposal of the alcohol are therefore reduced. The refluxing solution preferably is non-aqueous because water tends to inhibit the complexing reaction. Small amounts of water, however, may be present as an impurity without causing significant detrimental effects.

As soon as the melted deodorizer distillate is added to the refluxing solution, heating is discontinued and the heat released spontaneously during complex formation is removed by external means, such as a water bath. Crystallization begins immediately upon such addition and continues with gentle agitation of the reaction mixture. Then the reaction mixture is cooled and allowed to sit for several hours with occasional mixing. The immediate crystallization is substantial and is the result of the excess of urea which is present in the reaction mixture as one begins to add the deodorizer distillate. This drives the equilibrium in favor of complex formation and improves the ultimate yield of fatty acids. Other components which are unsuitable for complex formation, such as tocopherols and sterols, remain in solution.

Crystals of the complex containing mixed fatty acids are removed from the reaction mixture by filtration or other suitable means. The mother liquor which is left after crystal removal is saved for subsequent processing. Then the crystals are dried to remove alcohol. The dried crystals are admixed with water to dissolve them. As the urea dissolves in the water, the mixed fatty acids are released to form an organic layer. The fraction of mixed fatty acids is recovered by separating the organic layer.

The mixed tocopherols, sterols and other components which do not form complexes with urea are then recovered from the mother liquor by evaporating the alcohol to cause the formation of a residue. The residue consists of urea crystals admixed but not complexed with the mixed tocopherols, sterols and other components of the original raw material. The residue is mixed with water, and when the urea dissolves, the organic compounds separate into a fraction which is recovered by separating the organic layer as set forth above.

As a result of the process summarized above, raw deodorizer distillate is separated into a light fraction rich in fatty acids and a heavy fraction rich in tocopherols and sterols. Urea is recovered for re-use by combining the separated aqueous solutions containing urea and evaporating the water.

DESCRIPTION OF THE DRAWING

A preferred embodiment of the process of the present invention is illustrated in FIGURE I.

Methanol and urea are mixed in the Solution Preparation step and heated. Then molten deodorizer distillate is added in the Mixing step. The Complex Formation step begins immediately and cooling water is used to remove heat.

In the Separation step, the urea-fatty acid crystal complex is separated from the mother liquor. The complex is decomposed with the addition of water in a Complex Decomposition step. An organic layer rich in fatty acids is formed and removed in a Phase Separation step. The mother liquor is subject to an Evaporation step to remove alcohol. The residue from the evaporation is mixed with water in a Mixing step. An organic layer rich in tocopherols and sterols is formed and removed in a Phase Separation step.

Water containing urea from the Phase Separation steps is combined and evaporated in an Evaporation step. The urea is recycled.

Methanol evaporated from the mother liquor is condensed and recycled.

DETAILED DESCRIPTION OF THE INVENTION

The deodorizer distillates which are used as starting materials in accordance with the present invention are the byproducts of refining fats and oils derived from vegetable sources, including soybeans, corn, rapeseed, cottonseed, coconut, palm, peanut and rice bran. Deodorizer distillates from processing lard, tallow, and other fats and oils from animal sources are also useful.

Deodorizer distillates are generally characterized as having from about 20% to about 90% fatty acids. Typical fatty acids which are recovered according to the present invention include butyric, caproic, caprylic, capric, lauric, myristic, myristoleic, pentadecanoic, palmitic, palmitoleic, margaric, margaroleic, stearic, oleic, linoleic, linolenic, arachidic, gadoleic, eicosadienoic, behenic, erucic, docosadienoic and lignoceric. These fatty acids are useful in the oleo chemical industry for producing soap, detergents, resins and the like.

The sterols and tocopherols which are recovered in accordance with the present invention are both used as intermediates in pharmaceutical syntheses. Tocopherols, for example, are used to prepare Vitamin E and antioxidants.

The process of the present invention requires heating the deodorizer distillate until it is completely molten. Complete melting can generally be achieved at a temperature of from about 50° to about 80° C. The use of molten deodorizer distillate is a key element in the process of the invention. It provides an easily dispersed reactive liquid which is not diluted with a solvent. Accordingly, solvent use is avoided and the concentrated molten liquid pushes the reaction equilibrium to favor the formation of crystals.

A solution of urea and alcohol is prepared by mixing crystalline urea in an alcohol at a concentration from about 5 to about 75% by weight of the total mixture. Suitable alcohols include methanol, ethanol, propanol, isopropanol, butanol, isobutanol, tert-butanol and sec-butanol. The solution is preferably non-aqueous, but small amounts of water may be present as an impurity.

The solution of urea and alcohol is refluxed at a temperature near the boiling point of the alcohol and preferably at a temperature of from about 10° C. below the boiling point of the alcohol to about 2° C. above the boiling point of the alcohol. For methanol the boiling point is 64.7° C. at 760 millimeters Hg absolute pressure. The boiling points in degrees Celsius for the other alcohols at the same pressure are as follows: ethanol 78.4°; propanol 97.2°; isopropanol 82.4°; butanol 118.0°; isobutanol 108.1°; tert-butanol 82.6° and sec-butanol 99.5°.

As the molten distillate is added to the refluxing solution, a reaction mixture is formed having an excess of urea. This excess causes rapid formation of urea-fatty acid crystal complexes in an exothermic reaction. Heat is immediately removed from the reaction mixture to enhance crystal formation. The reaction mixture is agitated gently for from about 10 to about 60 minutes to encourage additional crystals to form and grow. Then the reaction mixture is cooled to a temperature from about 20° to about 40° C. for a period from about 1 to about 6 hours followed by cooling to ambient temperature for from about 1 to about 48 hours with occasional gentle agitation.

Crystals are separated from the reaction mixture by various means such as settling, filtration, and centrifugation. Any commercially available separating equipment and a vessel for receiving the mother liquor would be suitable as equipment for the separation step. The mother liquor which is left after the crystals are removed is saved for subsequent processing.

The separated crystals are dried to remove any remaining solvent. Drying can be carried out on conventional drying equipment including air convection ovens, vacuum ovens, rotary vacuum dryers and the like. Drying is preferably done with ambient air to avoid damage to the crystals.

The dry crystals are then dissolved in water to form an aqueous layer containing urea and an organic layer of mixed fatty acids. Sufficient water must be used to cause substantially all of the urea to be dissolved. Preferably, an excess of about 5 to about 50% water is utilized to insure dissolution of the urea.

The organic layer of mixed fatty acids is then recovered and the aqueous layer is saved for subsequent recovery of urea.

Mixed tocopherols and sterols are then recovered from the mother liquor which was saved for subsequent processing after the removal of crystals as noted above. Alcohol is first removed from the mother liquor. This can be accomplished by evaporation at atmospheric pressure or under vacuum. Evaporated alcohol is condensed and recycled. The residue left after removal of the alcohol contains urea crystals mixed with liquid organic material. The urea crystals are dissolved in water as set forth above and an organic layer of mixed organic materials rich in tocopherols and sterols is formed and separated. The aqueous layer is saved for subsequent recovery of urea.

The two aqueous layers containing urea which are saved from each of the separation steps are combined. Water is evaporated and the urea is recovered and recycled.

Some specific examples of the process of the present invention are as follows:

EXAMPLE I

Seventeen grams of deodorizer distillate (containing 89.2% free fatty acid as oleic acid) from corn oil deodorizing were melted by heating to 55°-60° C. The melted distillate was added to a refluxing solution of 45 grams of crystalline urea and 300 milliliters of methyl alcohol maintained with agitation at a temperature of 60° C. Complex formation was immediately evident. Heating was discontinued at the time of addition of the distillate and the mixture was cooled in a water bath to 30°-40° C. The mixture was further agitated gently for 30 minutes to enhance the formation of crystals. The vessel containing the solution and crystals was then left in the water bath at 20° to 25° C. and stirred occasionally over the next 16 hours. Voluminous needle crystals were formed.

The crystals were filtered in a Buchner funnel under vacuum provided by a water aspirator. Then the crystals were air dried at room temperature yielding 22 grams of dry crystals.

The dry crystals were dissolved by adding them to 50 milliliters of water maintained at 60° C. for 30 minutes. This caused the crystals to decompose and release fatty acid. During decomposition, released urea was dissolved in an aqueous layer and the fatty acid separated into an organic layer. The layers were separated in a separatory funnel maintained at 80° C. with a jacket, yielding a light organic fraction weighing 6 grams and 66 grams of an aqueous solution of urea. The fraction was rich in fatty acids and lean in tocopherols and sterols.

Mother liquor separated previously when the crystals were filtered in the Buchner funnel was concentrated by removing methyl alcohol. The alcohol was removed to dryness by roto-evaporation at 40°-50° C. and 100-200 millimeters Hg absolute pressure. The residue was cooled to room temperature. Fifty (50) milliliters of water were added to the residue and the mixture was maintained at 60° C. An organic fraction was separated in the same manner as set forth above. This yielded 8.8 grams of organic material and 76 grams of an aqueous solution of urea. The organic fraction was lean in fatty acids and rich in tocopherols and sterols.

The light organic fraction represented 35.3% of feed recovery by weight and the heavy organic fraction represented 51.8% of feed recovery by weight. Total recovery of the light and heavy fractions was 87.1%.

EXAMPLE II

Fifty grams of deodorizer distillate (containing 89.2% free fatty acid as oleic acid) from corn oil deodorizing were melted by heating to about 60° C. The melted distillate was added to a refluxing solution of 250 grams crystalline urea and 330 milliliters methyl alcohol maintained at a temperature of 64.5° C.±1° C. (Weight concentration of urea in methyl alcohol was 52%.) Complex formation was immediately evident. Heating was discontinued at the time of addition of the distillate and the solution was mixed for thirty minutes.

The solution was cooled in a water bath to 30°-40° C. with occasional gentle mixing during cooling to allow formation of crystals. The vessel containing the solution and crystals was then left in a water bath at ambient temperature (25°-28° C.) for forty-two hours. Voluminous needle crystals were formed.

The crystals were filtered in a Buchner funnel under vacuum provided by a water aspirator. This yielded 689 grams of wet crystals. The wet crystals were air dried at room temperature to yield 670 grams of solvent free (dry) crystals.

The dry crystals were dissolved by adding them to 600 milliliters of hot water at 70°-80° C. and then maintaining them at the same temperature for 30 minutes. This caused the crystals to decompose and release fatty acids. During decomposition, released urea was dissolved in an aqueous layer and the fatty acid separated into an organic layer. The layers were separated in a separatory funnel maintained at 80° C. with a jacket, yielding a light organic fraction weighing 38.9 grams. The fraction was rich in fatty acids and lean in tocopherols and sterols.

Mother liquor separated previously when the crystals were filtered in the Buchner funnel was concentrated by removing methyl alcohol. The methyl alcohol was removed to dryness by roto-evaporation at 40°-50° C. and 100-200 millimeters Hg absolute pressure. The residue was cooled to room temperature. Then 400 milliliters of hot water were added following the same procedures as set forth in Example 1. A heavy organic fraction weighing 8.5 grams was also separated by the same procedure as followed in Example 1. The fraction was lean in fatty acids and rich in tocopherols and sterols.

The light organic fraction represented 78% of feed recovery by weight and the heavy organic fraction represented 17.0% of feed recovery by weight. Total recovery of the light and heavy fractions was 87% of feed.

Having set forth a detailed description of the invention and some specific examples, the scope is now more particularly set forth in the appended claims.

What is claimed is:

1. A process for separating mixed fatty acids from a deodorizer distillate comprising the sequential steps of melting the deodorizer distillate; adding the melted deodorizer distillate to a refluxing solution of urea and alcohol to form a reaction mixture; mixing the reaction mixture while cooling to allow formation of crystals; separating the crystals; drying the crystals; dissolving the crystals in water to form an organic layer which is rich in mixed fatty acids and an aqueous layer containing urea; and separating the fatty acid layer.

2. The process of claim 1 wherein the deodorizer distillate is melted at a temperature of from about 50° C. to about 80° C. and the refluxing solution of urea and alcohol is maintained at a temperature of from about 10° C. below the boiling point of the alcohol to about 2° C. above the boiling point of the alcohol.

3. The process of claim 2 wherein the concentration of urea in the refluxing solution of urea and alcohol is from about 5 to about 75% by weight.

4. The process of claim 3 wherein the crystals are dried at ambient temperature.

5. The process of claim 4 wherein an excess of from about 5 to about 50% water is utilized to dissolve the crystals.

6. The process of claim 1 wherein the alcohol is selected from the group consisting of methanol, propanol, isopropanol, butanol, isobutanol, tert-butanol and sec-butanol.

7. The process of claim 6 wherein the deodorizer distillate is a byproduct from processing fats and oils from sources selected from the group consisting of soybeans, corn, rapeseed, cottonseed, coconut, palm, peanut, rice bran, lard and tallow.

8. The process of claim 1 wherein the mixed fatty acids are selected from the group consisting of butyric, caproic, caprylic, capric, lauric, myristic, myristoleic, pentadecanoic, palmitic, palmitoleic, margaric, margaroleic, stearic, oleic, linoleic, linolenic, arachidic, gadoleic, eicosadienoic, behenic, erucic, docosadienoic and lignoceric.

9. A process for separating mixed fatty acids from a deodorizer distillate in a two-stage process wherein the first stage comprises the sequential steps of melting the deodorizer distillate; adding the melted deodorizer distillate to a refluxing solution of urea and alcohol to form a reaction mixture; mixing the reaction mixture while cooling to allow formation of crystals; separating the crystals and saving the remaining mother liquor for processing in the second stage; drying the crystals; dissolving the crystals in water to form an organic layer which is rich in fatty acids and an aqueous layer containing urea; and separating the fatty acid layer; and wherein the second stage comprises the sequential steps of evaporating said mother liquor to form a residue; adding water to the residue to form an organic layer which is rich in tocopherols and sterols and an aqueous layer containing urea; and separating the organic layer.

10. The process of claim 9 wherein the deodorizer distillate is melted at a temperature of from about 50° C. to about 80° C. and the refluxing solution of urea and alcohol is maintained at a temperature of from about 10° C. below the boiling point of the alcohol to about 2° C. above the boiling point of the alcohol.

11. The process of claim 10 wherein the concentration of urea in the refluxing solution of urea and alcohol is from about 5 to about 75% by weight.

12. The process of claim 11 wherein the crystals are dried at ambient temperature.

13. The process of claim 12 wherein an excess of from about 5 to about 50% water is utilized to dissolve the crystals.

14. The process of claim 9 wherein the alcohol is selected from the group consisting of methanol, propanol, isopropanol, butanol, isobutanol, tert-butanol and sec-butanol.

15. The process of claim 14 wherein the deodorizer distillate is a byproduct from processing fats and oils from sources selected from the group consisting of soybeans, corn, rapeseed, cottonseed, coconut, palm, peanut, rice bran, lard and tallow.

16. The process of claim 9 wherein the mixed fatty acids are selected from the group consisting of butyric, caproic, caprylic, capric, lauric, myristic, myristoleic, pentadecanoic, palmitic, palmitoleic, margaric, margaroleic, stearic, oleic, linoleic, linolenic, arachidic, gadoleic, eicosadienoic, behenic, erucic, docosadienoic and lignoceric.

17. A process for separating mixed fatty acids from a deodorizer distillate in a two-stage process wherein the first stage comprises the sequential steps of melting a deodorizer distillate derived as a byproduct from processing fats and oils from vegetable materials; adding the melted deodorizer distillate to a refluxing solution of urea and methanol to form a reaction mixture; mixing the reaction mixture while cooling to allow formation of crystals; separating the crystals and saving the remaining mother liquor for processing in the second stage; drying the crystals; dissolving the crystals in water to form an organic layer which is rich in fatty acids and an aqueous layer containing urea; and separating the fatty acid layer; and wherein the second stage comprises the sequential steps of evaporating said mother liquor to form a residue; adding water to the residue to form an organic layer which is rich in tocopherols and sterols and an aqueous layer containing urea; and separating the organic layer.

18. The process of claim 17 wherein the vegetable materials are selected from the group consisting of soybeans, corn, rapeseed, cottonseed, coconut, palm, peanut, and rice bran.

19. The process of claim 18 wherein the mixed fatty acids are selected from the group consisting of butyric, caproic, caprylic, capric, lauric, myristic, myristoleic, pentadecanoic, palmitic, palmitoleic, margaric, margaroleic, stearic, oleic, linoleic, linolenic, arachidic, gadoleic, eicosadienoic, behenic, erucic, docosadienoic and lignoceric.

20. The process of claim 17 wherein the deodorizer distillate is melted at a temperature of from about 50° C. to about 80° C.; the refluxing solution of urea and alcohol is maintained at a temperature of from about 10° C. below the boiling point of the alcohol to about 2° C. above the boiling point of the alcohol; the concentration of urea in the refluxing solution of urea and alcohol is from about 5 to about 75% by weight; the crystals are dried at ambient temperature; and an excess of from about 5 to about 50% water is utilized to dissolve the crystals.

* * * * *